US010235824B1

(12) United States Patent
Ross

(10) Patent No.: US 10,235,824 B1
(45) Date of Patent: Mar. 19, 2019

(54) REACH-EXTENDING EXCHANGE DEVICE

(71) Applicant: Derek Ross, Suffolk, VA (US)

(72) Inventor: Derek Ross, Suffolk, VA (US)

( * ) Notice: Subject to any disclaimer, the term of this patent is extended or adjusted under 35 U.S.C. 154(b) by 0 days.

(21) Appl. No.: 15/820,098

(22) Filed: Nov. 21, 2017

(51) Int. Cl.

| | |
|---|---|
| ***B25B 9/00*** | (2006.01) |
| ***G07D 9/00*** | (2006.01) |
| ***G07D 1/08*** | (2006.01) |
| *A47G 23/00* | (2006.01) |

(52) U.S. Cl.
CPC ..... *G07D 9/002* (2013.01); *B25B 9/00* (2013.01); *G07D 1/08* (2013.01); *A47G 23/00* (2013.01)

(58) Field of Classification Search
CPC . A47F 13/08; E01H 1/1206; E01H 2001/128; E01H 2001/1286; A01K 23/005; G07D 9/002; G07D 1/08; B25B 9/00; A47G 23/00
USPC ..... 294/1.4, 1.5
See application file for complete search history.

(56) References Cited

U.S. PATENT DOCUMENTS

| | | | | |
|---|---|---|---|---|
| 729,929 A | | 6/1903 | Haines | |
| 2,592,192 A | * | 4/1952 | Sanford | A47G 21/04 30/326 |
| 4,042,269 A | * | 8/1977 | Skermetta | A01K 23/005 15/257.3 |
| 4,718,707 A | * | 1/1988 | Greenhut | E01H 1/1206 294/1.4 |
| 6,164,710 A | | 12/2000 | Shibuya | |
| 7,448,659 B1 | * | 11/2008 | Auseklis | E01H 1/1206 294/1.4 |
| 7,575,125 B2 | | 8/2009 | Bagley, Jr. | |
| 7,631,910 B2 | * | 12/2009 | Shalhoub | A01K 23/005 294/1.5 |
| 7,730,657 B1 | | 6/2010 | Gierucki | |
| 7,735,886 B2 | * | 6/2010 | Tsukamoto | A01K 23/005 294/1.5 |
| 7,775,568 B2 | * | 8/2010 | Scott | A01K 23/005 119/161 |
| 2011/0125674 A1 | | 5/2011 | Masters | |

* cited by examiner

*Primary Examiner* — Stephen A Vu

(57) ABSTRACT

A reach-extending exchange device for transferring articles between a teller and a customer includes a shell. The shell comprises an annular wall that extends between a top and a bottom. An aperture that is positioned in the top of the shell is configured to selectively position at least one article in the shell. A panel that is complementary to the aperture is slidably coupled to the top of the shell. A rod, which is elongated, is coupled to and extends from the shell. The panel is positioned to slide relative to the top to selectively close the aperture to retain the at least one article in the interior space. The rod is configured to be grasped in a hand of the teller to position the shell distal from the teller so that the customer can selectively position the at least one article in the shell.

14 Claims, 4 Drawing Sheets

REACH-EXTENDING EXCHANGE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to exchange devices and more particularly pertains to a new exchange device for transferring articles between a teller and a customer.

BRIEF SUMMARY OF THE INVENTION

An embodiment of the disclosure meets the needs presented above by generally comprising a shell. The shell comprises an annular wall that extends between a top and a bottom. An aperture that is positioned in the top of the shell is configured to selectively position at least one article in the shell. A panel that is complementary to the aperture is slidably coupled to the top of the shell. A rod, which is elongated, is coupled to and extends from the shell. The panel is positioned to slide relative to the top to selectively close the aperture to retain the at least one article in the interior space. The rod is configured to be grasped in a hand of a teller to position the shell distal from the teller so that a customer can selectively position the at least one article in the shell.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
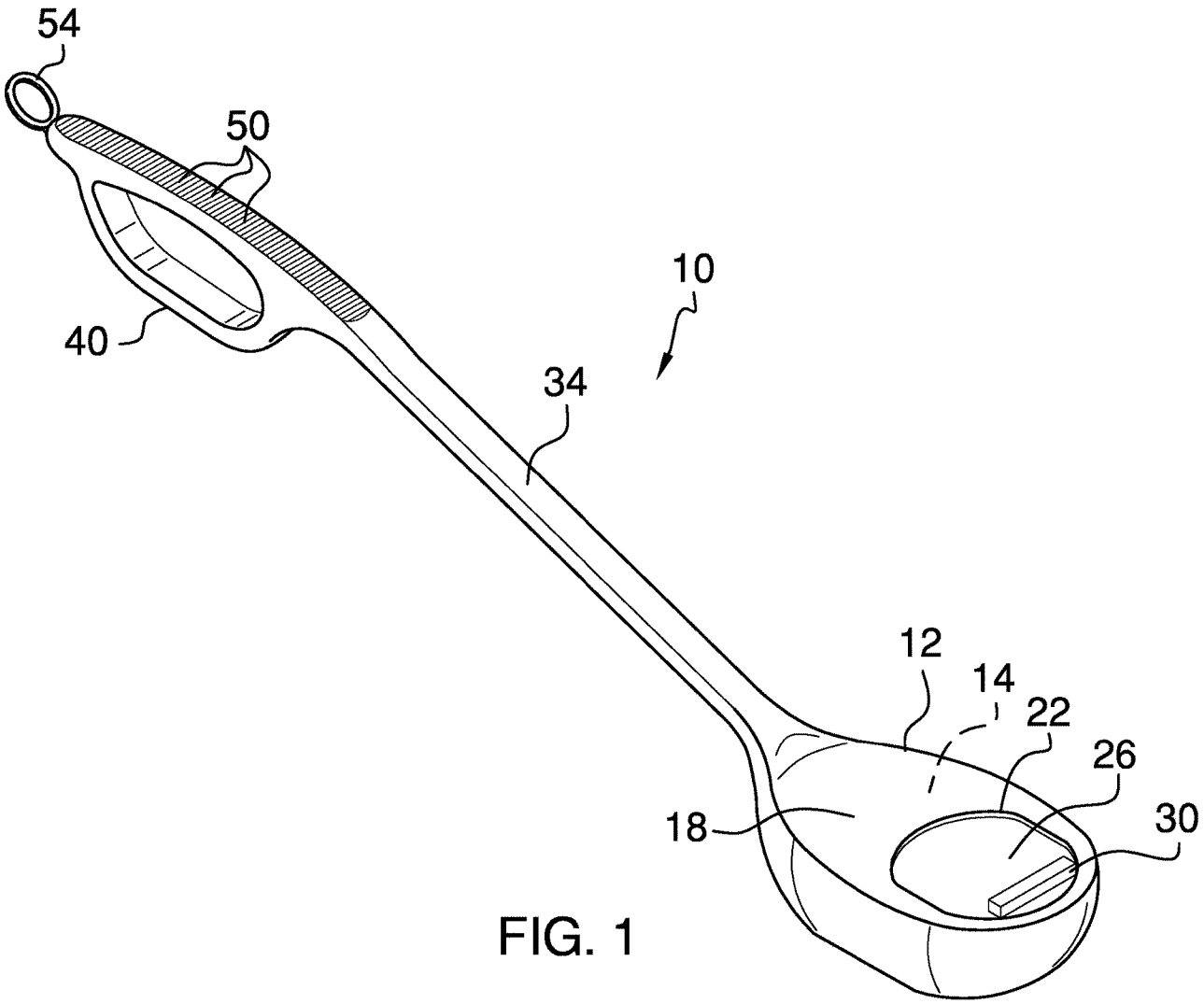
FIG. 1 is an isometric perspective view of a reach-extending exchange device according to an embodiment of the disclosure.
Figure 2:
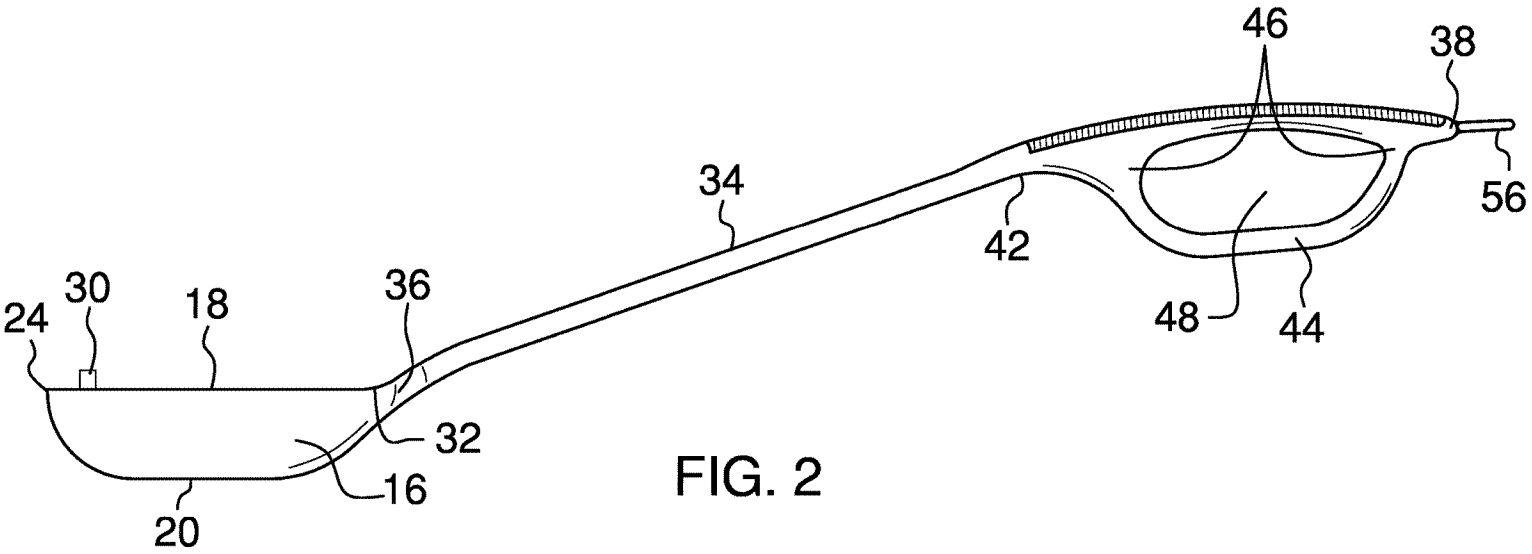
FIG. 2 is a side view of an embodiment of the disclosure.
Figure 3:
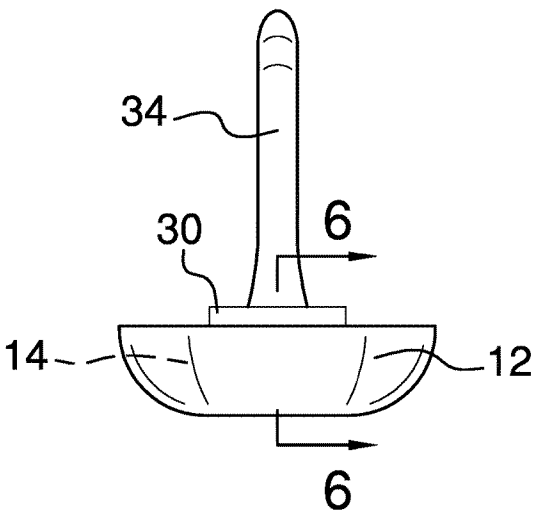
FIG. 3 is an end view of an embodiment of the disclosure.
Figure 4:
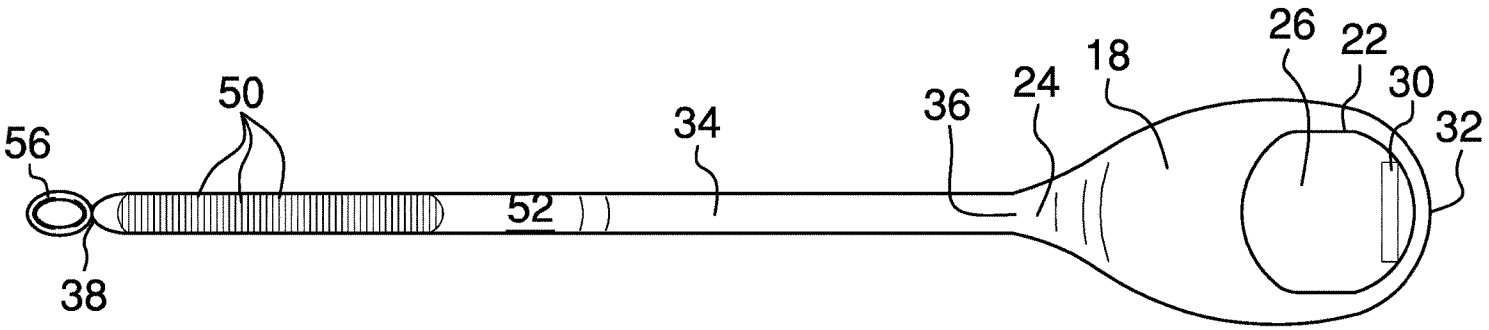
FIG. 4 is a top to view of an embodiment of the disclosure.
Figure 5:
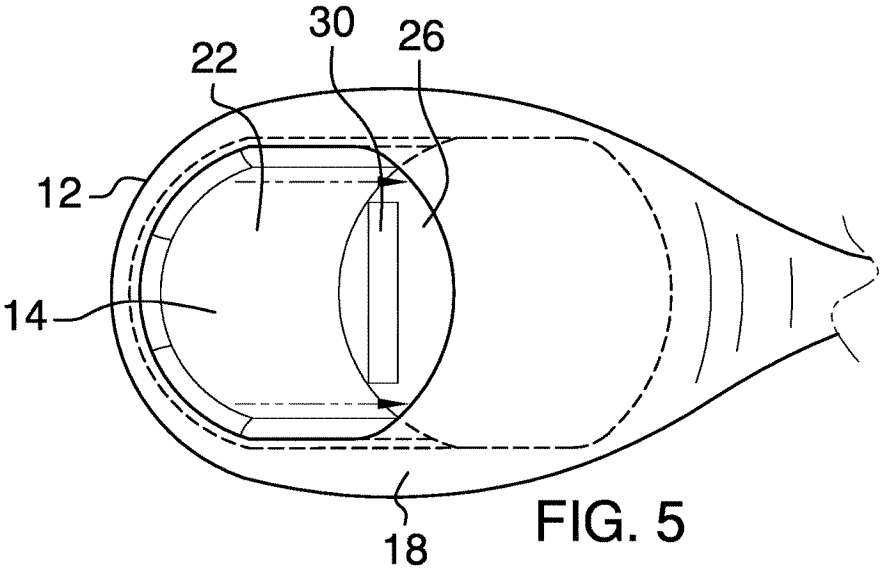
FIG. 5 is a detail view of an embodiment of the disclosure.
Figure 6:
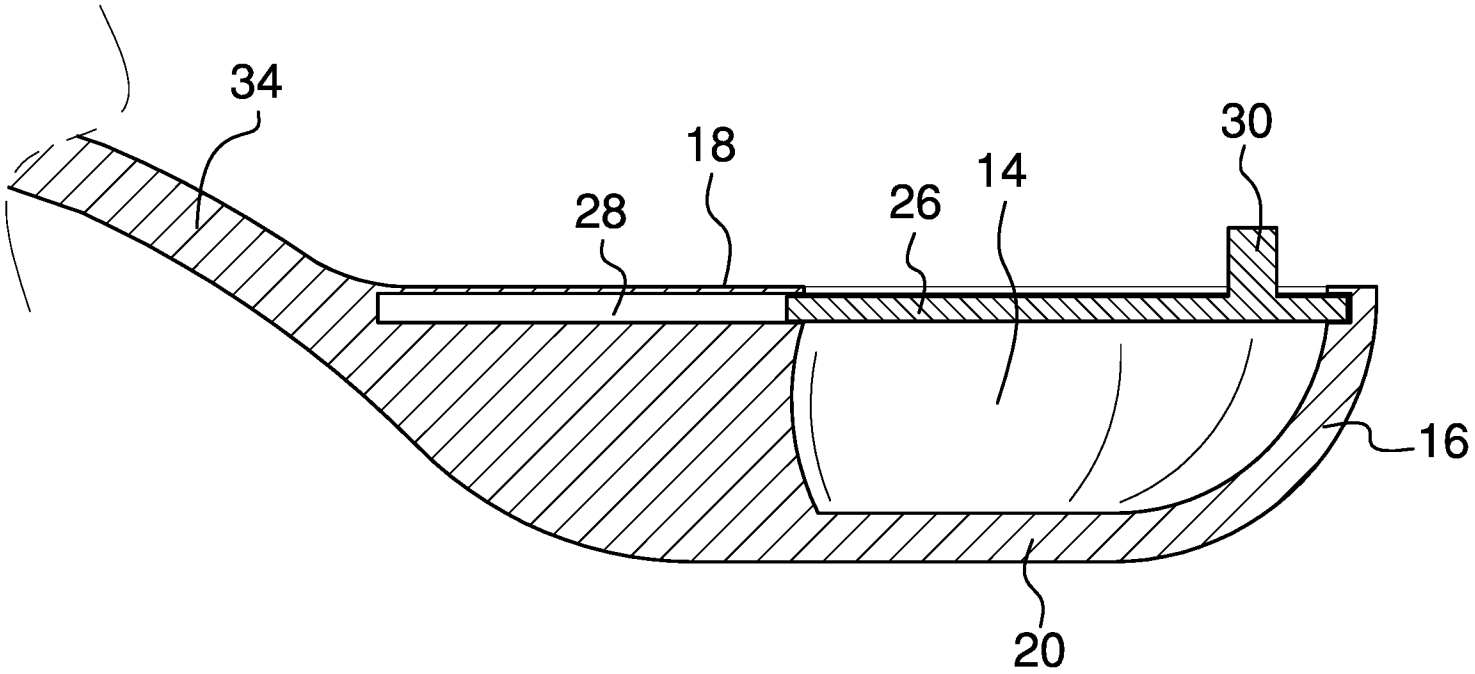
FIG. 6 is a cross-sectional view of an embodiment of the disclosure.

With reference now to the drawings, and in particular to FIGS. 1 through 6 thereof, a new exchange device embodying the principles and concepts of an embodiment of the disclosure and generally designated by the reference numeral 10 will be described.

As best illustrated in FIGS. 1 through 6, the reach-extending exchange device 10 generally comprises a shell 12 that defines an interior space 14. The shell 12 comprises an annular wall 16 that extends between a top 18 and a bottom 20. In one embodiment, the top 18 and the bottom 20 are substantially ovally shaped. The top 18 is dimensionally larger than the bottom 20. The annular wall 16 extends arcuately between the top 18 and the bottom 20.

An aperture 22 is positioned in the top 18 of the shell 12. The aperture 22 is configured to selectively position at least one article, such as currency, coinage, a credit card, a debit card, and a receipt in the interior space 14. In one embodiment, the aperture 22 is substantially ovally shaped. In another embodiment, the aperture 22 is positioned proximate to a first edge 24 of the top 18.

A panel 26 is slidably coupled to the top 18 of the shell 12. The panel 26 is complementary to the aperture 22. The panel 26 is positioned to slide relative to the top 18 to selectively close the aperture 22 to retain the at least one article in the interior space 14.

A channel 28 extends into the annular wall 16 from the interior space 14. The channel 28 is positioned proximate to the top 18. The panel 26 is complementary to and is positioned in the channel 28. The panel 26 is positioned to be slid within the channel 28 to selectively close the aperture 22 to retain the at least one article in the interior space 14.

A knob 30 is coupled to the panel 26. The knob 30 is configured to be grasped in digits of a hand of a user to slide the panel 26 within the channel 28 toward a second edge 32 of the top 18 to open the aperture 22 to position the at least one article, such as a payment for a good and a service, change for a transaction, and a receipt for the transaction. The panel 26 also is positioned to be slid toward the first edge 24 of the top 18 to close the aperture 22 to retain the at least one article in the interior space 14. In one embodiment, the knob 30 is substantially rectangularly box shaped when viewed longitudinally.

A rod 34 is coupled to and extends from the shell 12. The rod 34 is elongated. The rod 34 is configured to be grasped in a hand of a teller to position the shell 12 distal from the teller. The shell 12 is positioned so that a customer can position the at least one article, such as the payment for the good and the service, in the interior space 14. The shell 12 also is positioned so that the customer can retrieve the at least one article, such as the change for a transaction and the receipt for the transaction.

In one embodiment, the rod 34 extends from proximate to the second edge 32 of the top 18 of the shell 12. The rod 34 has a first end 36 and a second end 38. The first end 36 is coupled to the shell 12. In another embodiment, the rod 34 is arcuate proximate to the second end 38. In yet another embodiment, the second end 38 is arcuate.

A handle 40 is coupled to and extends from a lower surface 42 of the rod 34 proximate to the second end 38. The handle 40 is configured to be grasped in the hand of the teller to selectively extend the shell 12 toward the customer. In one embodiment, the handle 40 comprises a bar 44 that has opposing ends 46. Each opposing end 46 is coupled to the rod 34 to a loop 48. The loop 48 is configured to insert the hand of the teller to grasp the rod 34 to selectively extend the shell 12 toward the customer.

A plurality of ridges 50 is coupled to and extends from an upper surface 52 of the rod 34 proximate to the second end 38. The ridges 50 are configured to deter slippage of the rod 34 within the hand of the teller.

A connector 54 is coupled to and extends from the second end 38 of the rod 34. The connector 54 is configured to selectively couple the rod 34 to a surface to stow the first rod 34. In one embodiment, the coupler comprises a ring 56. The ring 56 is configured to insert a coupler that is coupled to the surface to couple the rod 34 to the surface to stow the first rod 34.

In use, the ridges 50 that are positioned on the rod 34 are configured to deter slippage of the rod 34 within the hand of the teller. The loop 48 is configured to insert the hand of the teller to grasp the rod 34 to selectively extend the shell 12 toward the customer. The knob 30 that is positioned on the panel 26 is configured to be grasped in the digits of the hand of the customer to slide the panel 26 within the channel 28 toward the second edge 32 of the top 18 to open the aperture 22. The shell is configured to position the at least one article, such as the payment for the good and the service, in the interior space 14. The panel 26 also is positioned to be slid toward the first edge 24 of the top 18 to close the aperture 22 to retain the at least one article in the interior space 14. The teller then is positioned to open the aperture 22 to collect the payment for the good and the service from the interior space 14, to position the change for the transaction and the receipt for the transaction in the interior space 14, to close the aperture 22 to secure the change and the receipt, and to again position the shell 12 proximate to the customer. The customer then is positioned to open the aperture 22 to collect the change for the transaction and the receipt for the transaction from the interior space 14. The ring 56 that is positioned on the rod 34 is configured to insert the coupler that is coupled to the surface to couple the rod 34 to the surface to stow the first rod 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A reach-extending exchange device comprising:

a shell defining an interior space, said shell comprising an annular wall extending between a top and a bottom;

an aperture positioned in said top of said shell;

a panel slidably coupled to said top of said shell, said panel being complementary to said aperture;

a rod coupled to and extending from said shell, said rod being elongated;

wherein said aperture is positioned in said shell such that said aperture is configured for selectively positioning at least one article in said interior space, wherein said panel is positioned on said shell such that said panel is positioned for sliding relative to said top for selectively closing said aperture for retaining the at least one article in said interior space, wherein said rod is positioned on said shell such that said rod is configured for grasping in a hand of a teller for positioning said shell distal from the teller such that said shell is positioned for a customer selectively positioning the at least one article in said interior space; and a plurality of ridges coupled to and extending from an upper surface of said rod proximate to a second end of said rod, wherein said ridges are positioned on said rod such that said ridges are configured for deterring slippage of said rod within the hand of the teller.

2. The device of claim 1, further including said top and said bottom being substantially ovally shaped, said top being dimensionally larger than said bottom such that said annular wall extends arcuately between said top and said bottom.

3. The device of claim 2, further including said aperture being substantially ovally shaped, said aperture being positioned proximate to a first edge of said top.

4. The device of claim 1, further including said rod having a first end and a second end, said first end being coupled to said shell, said rod being arcuate proximate to said second end.

5. The device of claim 1, further including said second end being arcuate.

6. The device of claim 1, further including a connector coupled to and extending from a second end of said rod, wherein said connector is positioned on said rod such that said connector is configured for facilitating stowing said rod.

7. The device of claim 6, further including said connector comprising a ring, wherein said ring is positioned on said rod such that said ring is configured for inserting a coupler coupled to the surface for coupling said rod to the surface for stowing said rod.

8. The device of claim 1, further comprising:

said top and said bottom being substantially ovally shaped, said top being dimensionally larger than said bottom such that said annular wall extends arcuately between said top and said bottom;

said aperture being substantially ovally shaped, said aperture being positioned proximate to a first edge of said top;

a channel extending into said annular wall from said interior space, said channel being positioned proximate to said top, said panel being complementary to and positioned in said channel, wherein said panel is positioned in said channel such that said panel is positioned for sliding within said channel for selectively closing said aperture for retaining the at least one article in said interior space;

a knob coupled to said panel, wherein said knob is positioned on said panel such that said knob is configured for grasping in digits of a hand of a user for sliding said panel within said channel toward a second edge of said top for opening said aperture for positioning the at least one article, wherein said panel is positioned for sliding toward said first edge of said top for closing said aperture for retaining the at least one article in said interior space, said knob being substantially rectangularly box shaped when viewed longitudinally;

said rod extending from proximate to said second edge of said top of said shell, said rod having a first end and a second end, said first end being coupled to said shell, said rod being arcuate proximate to said second end, said second end being arcuate;

a handle coupled to and extending from a lower surface of said rod proximate to said second end, wherein said handle is positioned on said rod such that said handle is configured for grasping in the hand of the teller for selectively extending said shell toward the customer, said handle comprising a bar having opposing ends, each said opposing end being coupled to said rod defining a loop, wherein said bar is positioned on said rod such that said loop is configured for inserting the hand of the teller for grasping said rod for selectively extending said shell toward the customer;

a connector coupled to and extending from said second end of said rod, said connector being configured for selectively coupling said rod to a surface, wherein said connector is positioned on said rod such that said connector is configured for coupling said rod to the surface for stowing said rod, said connector comprising a ring, wherein said ring is positioned on said rod such that said ring is configured for facilitating stowing said rod; and wherein said ridges are positioned on said rod such that said ridges are configured for deterring slippage of said rod within the hand of the teller, wherein said bar is positioned on said rod such that said loop is configured for inserting the hand of the teller for grasping said rod for selectively extending said shell toward the customer, wherein said knob is positioned on said panel such that said knob is configured for grasping in digits of the hand of the user for sliding said panel within said channel toward said second edge of said top for opening said aperture for positioning the at least one article, wherein said panel is positioned for sliding toward said first edge of said top for closing said aperture for retaining the at least one article in said interior space, wherein said ring is positioned on said rod such that said ring is configured for inserting the coupler coupled to the surface for coupling said rod to the surface for stowing said rod.

9. A reach-extending exchange device comprising:

a shell defining an interior space, said shell comprising an annular wall extending between a top and a bottom, said top and said bottom being substantially ovally shaped, said top being dimensionally larger than said bottom such that said annular wall extends arcuately between said top and said bottom;

an aperture positioned in said top of said shell, said aperture being substantially ovally shaped, said aperture being positioned proximate to a first edge of said top;

a panel slidably coupled to said top of said shell, said panel being complementary to said aperture;

a rod coupled to and extending from said shell, said rod being elongated;

wherein said aperture is positioned in said shell such that said aperture is configured for selectively positioning at least one article in said interior space, wherein said panel is positioned on said shell such that said panel is positioned for sliding relative to said top for selectively closing said aperture for retaining the at least one article in said interior space, wherein said rod is positioned on said shell such that said rod is configured for grasping in a hand of a teller for positioning said shell distal from the teller such that said shell is positioned for a customer selectively positioning the at least one article in said interior space; and a channel extending into said annular wall from said interior space, said channel being positioned proximate to said top, said panel being complementary to and positioned in said channel, wherein said panel is positioned in said channel such that said panel is positioned for sliding within said channel for selectively closing said aperture for retaining the at least one article in said interior space.

10. The device of claim 9, further including a knob coupled to said panel, wherein said knob is positioned on said panel such that said knob is configured for grasping in digits of a hand of a user for sliding said panel within said channel toward a second edge of said top for opening said aperture for positioning the at least one article, wherein said panel is positioned for sliding toward said first edge of said top for closing said aperture for retaining the at least one article in said interior space.

11. The device of claim 10, further including said knob being substantially rectangularly box shaped when viewed longitudinally.

12. The device of claim 10, further including said rod extending from proximate to said second edge of said top of said shell.

13. A reach-extending exchange device comprising:

a shell defining an interior space, said shell comprising an annular wall extending between a top and a bottom;

an aperture positioned in said top of said shell;

a panel slidably coupled to said top of said shell, said panel being complementary to said aperture;

a rod coupled to and extending from said shell, said rod being elongated, said rod having a first end and a second end, said first end being coupled to said shell, said rod being arcuate proximate to said second end;

wherein said aperture is positioned in said shell such that said aperture is configured for selectively positioning at least one article in said interior space, wherein said panel is positioned on said shell such that said panel is positioned for sliding relative to said top for selectively closing said aperture for retaining the at least one article in said interior space, wherein said rod is positioned on said shell such that said rod is configured for grasping in a hand of a teller for positioning said shell distal from the teller such that said shell is positioned for a customer selectively positioning the at least one article in said interior space; and a handle coupled to and extending from a lower surface of said rod proximate to said second end, wherein said handle is positioned on said rod such that said handle is configured for grasping in the hand of the teller for selectively extending said shell toward the customer.

14. The device of claim 13, further including said handle comprising a bar having opposing ends, each said opposing end being coupled to said rod defining a loop, wherein said bar is positioned on said rod such that said loop is configured for inserting the hand of the teller for grasping said rod for selectively extending said shell toward the customer.

* * * * *